US006676238B2

(12) United States Patent
Fujimura et al.

(10) Patent No.: US 6,676,238 B2
(45) Date of Patent: Jan. 13, 2004

(54) DRIVING METHOD AND APPARATUS FOR LIQUID DISCHARGE HEAD

(75) Inventors: Hidehiko Fujimura, Tokyo (JP); Ryoko Horie, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/241,537

(22) Filed: Sep. 12, 2002

(65) Prior Publication Data

US 2003/0067500 A1 Apr. 10, 2003

(30) Foreign Application Priority Data

Sep. 28, 2001 (JP) ..... 2001-300896

(51) Int. Cl.[7] ..... B41J 29/38
(52) U.S. Cl. ..... 347/11; 347/9; 347/10
(58) Field of Search ..... 347/10, 11

(56) References Cited

U.S. PATENT DOCUMENTS

| | | | | |
|---|---|---|---|---|
| 3,946,398 A | | 3/1976 | Kyser et al. | 347/70 |
| 4,563,689 A | | 1/1986 | Murakami et al. | 347/11 |
| 4,879,568 A | | 11/1989 | Bartky et al. | 347/69 |
| 5,202,659 A | | 4/1993 | DeBonte et al. | 347/11 |
| 5,754,194 A | | 5/1998 | Endo et al. | 347/15 |
| 6,059,393 A | * | 5/2000 | Takahashi | 347/11 |
| 6,141,113 A | * | 10/2000 | Takahashi | 358/1.8 |
| 6,412,925 B1 | * | 7/2002 | Takahashi | 347/69 |

FOREIGN PATENT DOCUMENTS

| | | |
|---|---|---|
| JP | 53-12138 | 4/1978 |
| JP | 61-59914 | 12/1986 |
| JP | 63-247051 | 10/1988 |
| JP | 3-30506 | 4/1991 |
| JP | 6-55513 | 7/1994 |
| JP | 2000-280463 | 10/2000 |

* cited by examiner

*Primary Examiner*—Stephen D. Meier
*Assistant Examiner*—Alfred E Dudding
(74) *Attorney, Agent, or Firm*—Fitzpatrick, Cella, Harper & Scinto

(57) ABSTRACT

A driving method for a liquid discharge head having a discharge port for discharging liquid; a pressure-applying portion communicating with the discharge port, for applying discharge pressure to the liquid; and a pressure generating device for generating the pressure. The method includes a step of applying first and second discharge pulses for discharging liquid, to the pressure generating device in a sequential manner in response to a one-dot discharge instruction. The pulse widths of the first and second discharge pulses and a rest time between the first and second discharge pulses are determined so that the volume of a first liquid discharged in response to the first discharge pulse is equal to or greater than that of a second liquid discharged in response to the second discharge pulse and the discharge speed of the first liquid is lower than the discharge speed of the second liquid.

10 Claims, 9 Drawing Sheets

VA'
t

+
F
t
−
Tr/2 Tr/2 Tr/2 Tr/2

VA
T1
t
3×Tr/2

+
F0
t
−

VA
VB
M12
T2
M23
t

+
F1
t
t0
t0'
t1
t3
t5
−
t2
t4

DRIVING METHOD AND APPARATUS FOR LIQUID DISCHARGE HEAD

BACKGROUND OF THE INVENTION

1. Field of the Invention

The present invention relates to a driving method and apparatus for a liquid discharge head for use in printing as well as in manufacturing color filters, thin film transistors, light-emitting devices, DNA devices, and the like.

2. Related Background Art

A liquid discharge apparatus has begun to be used for producing printed materials as well as for a patterning process in manufacturing color filters, thin film transistors, light-emitting devices, DNA devices, and the like.

Photolithography is widely adopted for such an industrial patterning method. However, the photolithography requires many steps and the cost for devices is huge, while providing extremely low material-use efficiency. Meanwhile, offset printing has a limitation on use as an industrial patterning technique due to the precision thereof.

Under the circumstances, a patterning method using a liquid discharge head, which is also called ink jet method, has become popular. The ink jet method allows for direct plotting on a patterning portion, thereby providing extremely high material-use efficiency while requiring a small number of steps, which is a useful patterning technique with low running cost.

Well-known ink jet methods are of the Kyser type described in Japanese Patent Publication No. 53-12138 and of the thermal jet type disclosed in Japanese Patent Publication No. 61-59914 (U.S. Pat. No. 5,754,194).

A shear-mode ink jet method using a piezoelectric ceramic is disclosed in Japanese Patent Application Laid-Open No. 63-247051 (U.S. Pat. No. 4,879,568).

As shown in FIGS. 9A and 9B, an ink jet head (liquid discharge head) 500 incorporating a shear-mode pressure generating device includes a bottom wall 501, a top wall 502, and shear-mode actuator walls 503. Each of the actuator walls 503 is formed of a lower wall 507 which is bonded to the bottom wall 501 and which is polarized in the direction indicated by an arrow 511, and an upper wall 505 which is bonded to the top wall 502 and which is polarized in the direction indicated by an arrow 509. A pair of adjacent actuator walls 503 forms an ink flow path (pressure-applying portion) 506. An air chamber 508 formed of a gap containing no ink is provided between adjacent ink flow paths 506.

An orifice plate 512 having a nozzle 510 is bonded to one end of each ink flow path 506, and electrodes 513 and 514 are provided as metallized layers on both sides of each actuator wall 503. More specifically, each actuator wall 503 is provided with the electrode 514 on the side of the ink flow path 506, and is provided with the electrode 513 on the side of the air chamber 508. The electrodes 513 facing the air chamber 508 are connected to a control circuit 520 for supplying an actuator driving signal, while the electrodes 514 defining the ink flow path 506 are connected to a ground.

A voltage is applied by the control circuit 520 to the electrodes 513 beside the air chambers 508, thus causing the actuator walls 503 to produce shear strain deformation in the direction where the volume of the ink flow paths 506 increases.

For example, as shown in FIG. 10, when a driving voltage is applied to the electrodes 513 beside the air chambers 508, an electric field is generated in the actuator walls 505 and 507 in the directions orthogonal to the respective polarizations as indicated by arrows, thus causing shear strain deformation of the actuator walls 505 and 507 in the direction where the volume of the ink flow path 506 increases. Then, a pressure decreases in the ink flow path 506 including the vicinity of the nozzle 510, so that ink is dispensed from an ink common flow path (not shown) on an ink supply side.

If the hydrodynamic resonant frequency of the inside of the ink flow path 506 is indicated by Fr, an inverse thereof is indicated by Tr (=1/Fr), and the time during which the voltage is applied is set to Tr/2, resonance across the system can be used, thereby making the amount of deformation greater than the original amount obtained as shear strain (non-resonance).

The hydrodynamic resonant frequency Fr can be determined by electric measurement using a well-known impedance measurement device. FIG. 11 shows the relationship between the measurement data obtained by the impedance measurement device (the frequency dependency of impedance) and the hydrodynamic resonant frequency Fr.

After the lapse of the voltage-applying time Tr/2, the voltage applied to the electrodes 513 beside the air chambers 508 is reset to zero. Then, the actuator walls 505 and 507 are deformed so that the ink flow path 506 may contract more than the normal state where the actuator walls 505 and 507 are not deformed and form a straight flow path, thus causing ink to be pressurized. This allows the ink to flow into the nozzles 510, and ink droplets are expelled from the nozzles 510.

In conventional ink ejecting apparatuses of this type, the volume of an ink droplet to be ejected depends upon the shape of an ink flow path, a driving voltage, and the like. Therefore, the shape of an ink flow path and the driving voltage are determined so that desired volume of an ink droplet can be obtained. If an ink jet apparatus is used as an industrial plotter, however, there are demands for high-definition ink jet performance, and for shorter plotting time. In order to shorten the plotting time, it is necessary to reduce the number of pulses required for plotting as much as possible. For higher definition, the pitch of an ink flow path is made narrower, thereby increasing the definition. In order to narrow the pitch of an ink flow path, in view of the limitation of machining, the thickness of a PZT (lead zirconate titanate) wall, which is a piezoelectric ceramic wall and which can change the volume of the ink flow path, must be reduced, and the depth of the ink flow path must also be reduced. This further leads to a limitation of driving voltage. Eventually, a high-definition head reduces the amount of deformation cause by the PZT wall, resulting in a reduced amount of discharge per dot.

On the other hand, Japanese Patent Publication No. 3-30506 (U.S. Pat. No. 4,563,689) describes that an additional pulse is applied before an application of the main pulse in order to determine the top position of ink meniscus in a nozzle, thereby controlling the volume of an ink droplet. By applying an additional pulse, the volume of an ink droplet can be slightly, but not significantly, increased.

Japanese Patent Application Laid-Open No. 2000-280463 describes a proposed method in which the volume of an ink droplet is increased by providing a pulse having a width of 0.30 T to 1.10 T as an additional emission (first emission) pulse before an application of a main emission (second emission) pulse, where T denotes the pulse width of the main emission pulse. In this method, two ink droplets are discharged to form one dot, thus making it possible to increase the volume of an ink droplet by a factor of up to about 1.5. However, it is difficult to further increase the amount of discharge.

As proposed in Japanese Patent Publication No. 6-55513 (U.S. Pat. No. 5,202,659), in order to increase the amount of discharge, a plurality of ink droplets which are sequentially ejected using a resonant frequency are combined in the air to control the volume of the ink droplets. With this approach, it can be expected that the volume of ink droplets sufficiently increases.

In an industrial ink jet apparatus, however, if the distance between a nozzle and a plotted base is extremely shortened in order to increase the deposition precision, a plurality of liquid drops are not combined in the air, but reach the base individually. In other words, there occurs a time lag in ink droplets to be applied for one-dot plotting, causing the reached drops do not form perfect circles, resulting in a failure of deposition precision.

SUMMARY OF THE INVENTION

Accordingly, it is an object of the present invention to provide a driving method and apparatus for a liquid discharge head in which the volume of a liquid drop can increase and the drop can reach with high precision even if the distance between a head nozzle and a plotted base is short.

It is another object of the present invention to provide a driving method and apparatus for a liquid discharge head which are also suitably used for an industrial patterning apparatus.

In order to achieve the above-mentioned object, according to a gist of the present invention, there is provided a driving method for a liquid discharge head including: a discharge port for discharging liquid; a pressure-applying portion communicating with the discharge port, for applying a pressure for discharge to the liquid; and a pressure generating device for generating the pressure, the method including a step of applying a first discharge pulse for discharging liquid and a second discharge pulse for discharging liquid to the pressure generating device in a sequential manner in response to an instruction of one-dot discharge, in which the pulse width of the first discharge pulse, the pulse width of the second discharge pulse, and a rest time between the first discharge pulse and the second discharge pulse are determined so that a first liquid discharged in response to the first discharge pulse has a volume equal to or greater than a second liquid discharged in response to the second discharge pulse and the discharge speed of the first liquid is lower than the discharge speed of the second liquid.

According to another gist of the present invention, there is provided a driving apparatus for a liquid discharge head including: a discharge port for discharging liquid; a pressure-applying portion communicating with the discharge port, for applying a pressure for discharge to the liquid; and a pressure generating device for generating the pressure, the apparatus including a driving circuit for applying a first discharge pulse for discharging liquid and a second discharge pulse for discharging liquid to the pressure generating device in a sequential manner in response to an instruction of one-dot discharge, in which the pulse width of the first discharge pulse, the pulse width of the second discharge pulse, and a rest time between the first discharge pulse and the second discharge pulse are determined so that a first liquid discharged in response to the first discharge pulse has a volume greater than a second liquid discharged in response to the second discharge pulse and the discharge speed of the first liquid is lower than the discharge speed of the second liquid.

According to still another gist of the present invention, there is provided a liquid discharge apparatus including: a liquid discharge head having: a discharge port for discharging liquid; a pressure-applying portion communicating with the discharge port, for applying a pressure for discharge to the liquid; and a pressure generating device for generating the pressure; a driving circuit for applying a first discharge pulse for discharging liquid and a second discharge pulse for discharging liquid to the pressure generating device in a sequential manner in response to an instruction of one-dot discharge; and a support for supporting a liquid-receiving member for receiving the liquid, in which the pulse width of the first discharge pulse, the pulse width of the second discharge pulse, and a rest time between the first discharge pulse and the second discharge pulse are determined so that a first liquid discharged in response to the first discharge pulse has a volume greater than a second liquid discharged in response to the second discharge pulse and the discharge speed of the first liquid is lower than the discharge speed of the second liquid, and in which a position of the liquid discharging head and a position of the support are determined so that the first liquid and the second liquid are combined to be applied to the liquid-receiving member.

According to the present invention, the first and second liquid drops are combined in a short discharge range, thus allowing the combined larger droplet to reach a liquid-receiving member with high precision.

In the present invention, the pulse width T1 and the pulse width $T_2$, and the rest time $K_{12}$ may be determined based on the hydrodynamic resonant frequency of the liquid discharge head. This enables liquid drops to be most effectively applied to the liquid-receiving member.

Also, according to another gist of the present invention, there is provided a driving method for a liquid discharge head including: a discharge port for discharging liquid; a pressure-applying portion communicating with the discharge port, for applying a pressure for discharge to the liquid; and a pressure generating device for generating the pressure, the method including a step of applying a first discharge pulse for discharging liquid and a second discharge pulse for discharging liquid to the pressure generating device in a sequential manner in response to an instruction of one-dot discharge, in which the following three equations are satisfied:

$$T_1=k_1\times N\times Tr/2$$

$$T_2=k_2\times Tr/2$$

$$K_{12}=k_3\times(3Tr/4-T_2/2),$$

for $k_1$, $k_2$, and $k_3$ each ranging from 0.9 to 1.1, where N denotes an odd number more than one, Tr denotes an inverse of the hydrodynamic resonant frequency of the liquid discharge head, $T_1$ denotes the pulse width of the first discharge pulse, $T_2$ denotes the pulse width of the second discharge pulse, and $K_{12}$ denotes the rest time between the first discharge pulse and the second discharge pulse.

According to still another gist of the present invention, there is provided a driving apparatus for a liquid discharge head including: a discharge port for discharging liquid; a pressure-applying portion communicating with the discharge port, for applying a pressure for discharge to the liquid; and a pressure generating device for generating the pressure, the apparatus including a driving circuit for applying a first discharge pulse for discharging liquid and a second discharge pulse for discharging liquid to the pressure generating device in a sequential manner in response to an instruction of one-dot discharge, wherein the following three equations are satisfied:

$$T_1=k_1\times N\times Tr/2$$

$$T_2=k_2\times Tr/2$$

$$K_{12}=k_3\times(3Tr/4-T_2/2),$$

for $k_1$, $k_2$, and $k_3$ each ranging from 0.9 to 1.1, where N denotes an odd number more than one, Tr denotes an inverse of the hydrodynamic resonant frequency of the liquid discharge head, $T_1$ denotes the pulse width of the first discharge pulse, $T_2$ denotes the pulse width of the second discharge pulse, and $K_{12}$ denotes the rest time between the first discharge pulse and the second discharge pulse.

According to the present invention, the second liquid drop has a slightly smaller volume than that of the first liquid drop, while increasing the discharge speed of the liquid drops. Thus, two liquid drops can be combined in a short discharge range.

Also, according to the present invention, it is preferable that the driving circuit applies a non-discharge pulse, in response to which liquid is not discharged, subsequently to the second discharge pulse, and the following equations are satisfied:

$$T_3=k_4\times Tr/2$$

$$K_{23}=k_5\times(3Tr/2-T_2/2-T_3/2),$$

for $k_4$ ranging from 0.2 to 0.5 and $k_5$ ranging from 0.9 to 1.1, where $T_3$ denotes the pulse width of the non-discharge pulse, and $K_{23}$ denotes the rest time between the second discharge pulse and the non-discharge pulse.

In this case, vibration, which is often large up to now, after discharging a liquid drop, can immediately be suppressed.

Also, according to the present invention, it is preferable that there is provided a driving signal including the first discharge pulse and the second discharge pulse to liquid discharge heads, the liquid discharge heads forming a liquid discharge head group having a plurality of the discharge ports, a plurality of the pressure-applying portions, and a plurality of the pressure generating devices, in which the pulse width of the first discharge pulse, the pulse width of the second discharge pulse, and the rest time have the same value.

In this case, there is no need for optimizing a pulse train for each liquid discharge head. Therefore, liquid discharge heads having some non-uniform discharge characteristics due to fluctuation in production would successfully be driven.

Further, according to another gist of the present invention, there is provided a driving method for a liquid discharge head including: a discharge port for discharging liquid; a pressure-applying portion communicating with the discharge port, for applying a pressure for discharge to the liquid; and a pressure generating device for generating the pressure, the method including a driving circuit for applying a first discharge pulse for discharging liquid and a second discharge pulse for discharging liquid to the pressure generating device in a sequential manner in response to an instruction of one-dot discharge, in which the following three equations are satisfied:

$$T_1>Tr$$

$$T_2=T_1/N$$

$$K_{12}=3T_1/2N-T_2/2,$$

where N denotes an odd number more than one, Tr denotes an inverse of the hydrodynamic resonant frequency of the liquid discharge head, $T_1$ denotes the pulse width of the first discharge pulse, $T_2$ denotes the pulse width of the second discharge pulse, and $K_{12}$ denotes the rest time between the first discharge pulse and the second discharge pulse.

Also, according to still another gist of the present invention, there is provided a driving apparatus for a liquid discharge head including: a discharge port for discharging liquid; a pressure-applying portion communicating with the discharge port, for applying a pressure for discharge to the liquid; and a pressure generating device for generating the pressure, the apparatus including a driving circuit for applying a first discharge pulse for discharging liquid and a second discharge pulse for discharging liquid to the pressure generating device in a sequential manner in response to an instruction of one-dot discharge, in which the following three equations are satisfied:

$$T_1>Tr$$

$$T_2T_1/2$$

$$K_{12}=3T_1/2N-T_2/2,$$

where N denotes an odd number more than one, Tr denotes an inverse of the hydrodynamic resonant frequency of the liquid discharge head, $T_1$ denotes the pulse width of the first discharge pulse, $T_2$ denotes the pulse width of the second discharge pulse, and $K_{12}$ denotes the rest time between the first discharge pulse and the second discharge pulse.

According to the present invention, the second liquid drop has a slightly smaller volume than that of the first liquid drop, while increasing the discharge speed of the liquid drops. Thus, two liquid drops can be combined in a short discharge range.

Also according to the present invention, it is preferable that the driving circuit applies a non-discharge pulse, in response to which liquid is not discharged, subsequently to the second discharge pulse, and the following equations are satisfied:

$$T_3<Tr/2,$$

$$K_{23}=3T_1\times N-T_2/2-T_3/2,$$

where $T_3$ denotes the pulse width of the non-discharge pulse, and $K_{23}$ denotes the rest time between the second discharge pulse and the non-discharge pulse.

Also in this case, vibration, which is often large up to now, after discharging a liquid drop, can immediately be suppressed.

DESCRIPTION OF THE PREFERRED EMBODIMENTS

Figure 1A:
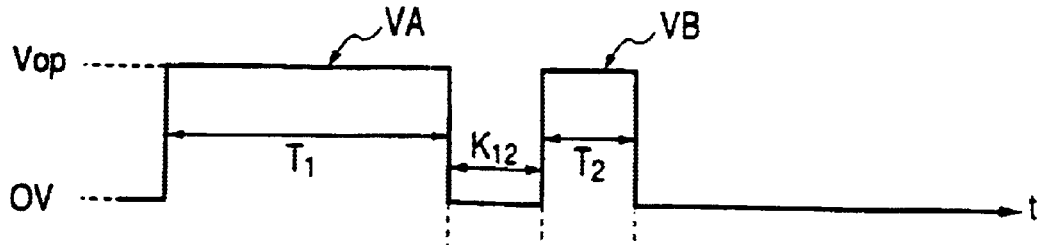
FIGS. 1A and 1B are views for illustrating a driving method for a liquid discharge head according to an embodiment of the present invention.
Figure 1B:
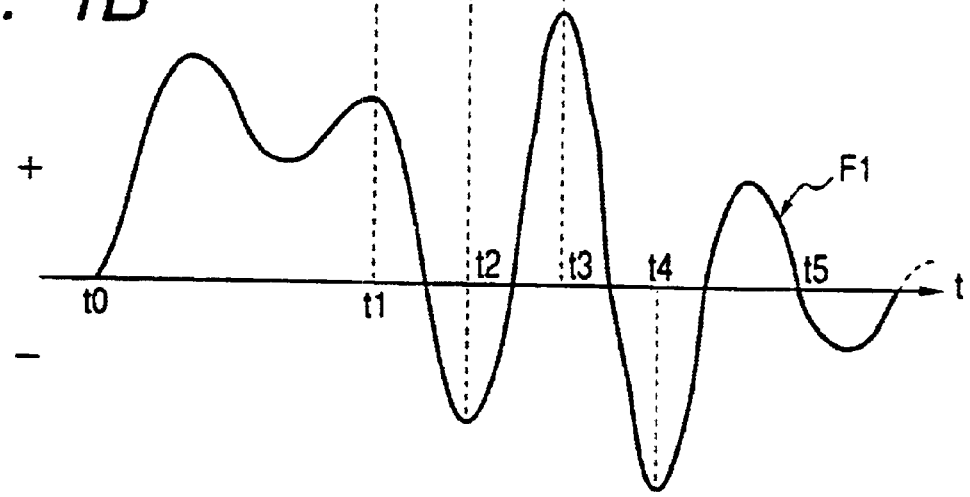
Figure 2:
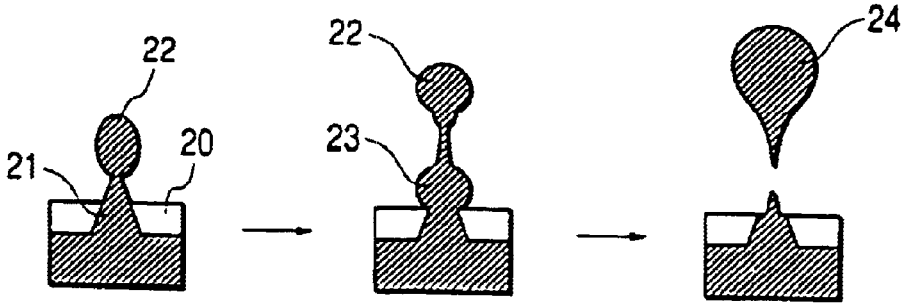
FIG. 2 is a schematic view for illustrating discharged liquid drops according to the embodiment of the present invention.

FIGS. 1A, 1B and 2 are views for illustrating a driving method for a liquid discharge head according to an embodiment of the present invention. The present invention may use a liquid discharge head having the same configuration as that shown in FIGS. 9A, 9B and 10.

FIG. 1A shows a driving signal (instruction of one-dot discharge) for driving a liquid discharge head. The liquid discharge head includes a discharge port for discharging liquid, a pressure-applying portion communicating with the discharge port for applying a pressure to the liquid, and a pressure generating device for generating the pressure.

FIG. 1B shows vibration state of the pressure generating device in the liquid discharge head, in which a positive (+) value indicates a displacement of the pressure generating device in the direction where the volume of the pressure-applying portion becomes higher than the normal state and a negative (−) value indicates a displacement of the pressure generating device in the direction where the volume of the pressure-applying portion becomes lower than the normal state.

At time t0, when a driving pulse (first discharge pulse VA) rises and reaches voltage Vop, the pressure generating device causes shear strain deformation, thus increasing the volume of the pressure-applying portion, so that liquid is introduced to the pressure-applying portion from the upstream.

At time t1, when the driving pulse falls, the shear strain deformation of the pressure generating device is cancelled, and a force for restoring the deformed pressure generating device to the original state causes the volume of the pressure-applying portion to decrease, so that the liquid is pressurized within the pressure-applying portion. The vibration makes the volume of the pressure-applying portion lower than that at the time t0, and causes the liquid to be pressurized and discharged from the discharge port.

At time t2, when the driving pulse (second discharge pulse VB) rises again, the discharged liquid forms a large liquid drop 22.

In response to the second discharge pulse VB, the pressure-applying portion expands again.

At time t3, when the second discharge pulse VB falls, the vibration amplitude of the pressure generating device is maximum. Then, the pressure-applying portion contracts again, allowing liquid corresponding to a second liquid drop 23 to be discharged.

At time t4, the discharged liquid forms the second liquid drop 23, and outgoes from the discharge port. Since the second liquid drop 23 has large vibration amplitude at the time t3, the second liquid drop 23 is discharged at a higher speed than the first liquid drop 22.

In short, two liquid drops are emitted in response to two discharge pulses for an instruction of one-dot discharge. The first liquid drop 22 discharged in response to the first discharge pulse can be discharged with delay by 15 to 20% with respect to the second liquid drop 23 discharged in response to the second discharge pulse. Therefore, even if the distance between the discharge port and the plotted base (liquid-receiving member) is as small as 500 $\mu$m or lower, the first liquid drop 22 can be combined in the air with the second liquid drop 23 to become a large liquid drop 24 before the first liquid drop 22 reach the liquid-receiving member. In addition, the volume of the first liquid drop 22 is the same as or slightly smaller than that of the second liquid drop 23.

By driving in response to the first and second discharge pulses for an instruction of one-dot discharge, a liquid drop having a volume 1.8 to 2.0 times that when driving in response to either the first or second discharge pulse for an instruction of one-dot discharge can be reached as the same dot. Volumes of the drops 22 and 23 can be calculated approximately based on a circle on an oval formed by projecting the same drops onto a plan view as shown in FIG. 2.

In this embodiment of the present invention, preferably, a third non-discharge pulse subsequent to the second discharge pulse may be applied at about time t5. This makes it possible to effectively reduce vibration of the liquid in the pressure-applying portion after the discharge, resulting in ejection of relatively low viscosity ink at a high frequency.

In order to successfully form the above-described liquid drops, the driving pulse train should be set as follows:

The following three equations are satisfied:

$$T_1 > Tr$$

$$T_2 = T_1/2$$

$$K_{12} = 3T_1/2N - T_2/2,$$

where N denotes an odd number more than one, Tr denotes an inverse of the hydrodynamic resonant frequency of the liquid discharge head, $T_1$ denotes the pulse width of the first discharge pulse, $T_2$ denotes the pulse width of the second discharge pulse, and K12 denotes the rest time between the first discharge pulse and the second discharge pulse.

More preferably, the following equations are satisfied:

$$T_3 < Tr/2$$

$$K_{23} = 3T_1/N - T_2/2 - T_3/2,$$

where $T_3$ denotes the pulse width of the non-discharge pulse, and $K_{23}$ denotes the rest time between the second discharge pulse and the non-discharge pulse.

Preferably, $T_1$ is N times Tr/2 based on the hydrodynamic resonant frequency.

While the example where N=3 is shown in FIGS. 1A and 1B, N=5, 7, 9 . . . may also be available.

A preferred form of the driving method for a liquid discharge head according to the present invention is now described in more detail with reference to FIGS. 3A, 3B, 3C, 3D, 3E and 3F and FIGS. 4G and 4H.

Figures 3A, 3B, 3C, 3D, 3E, 3F:
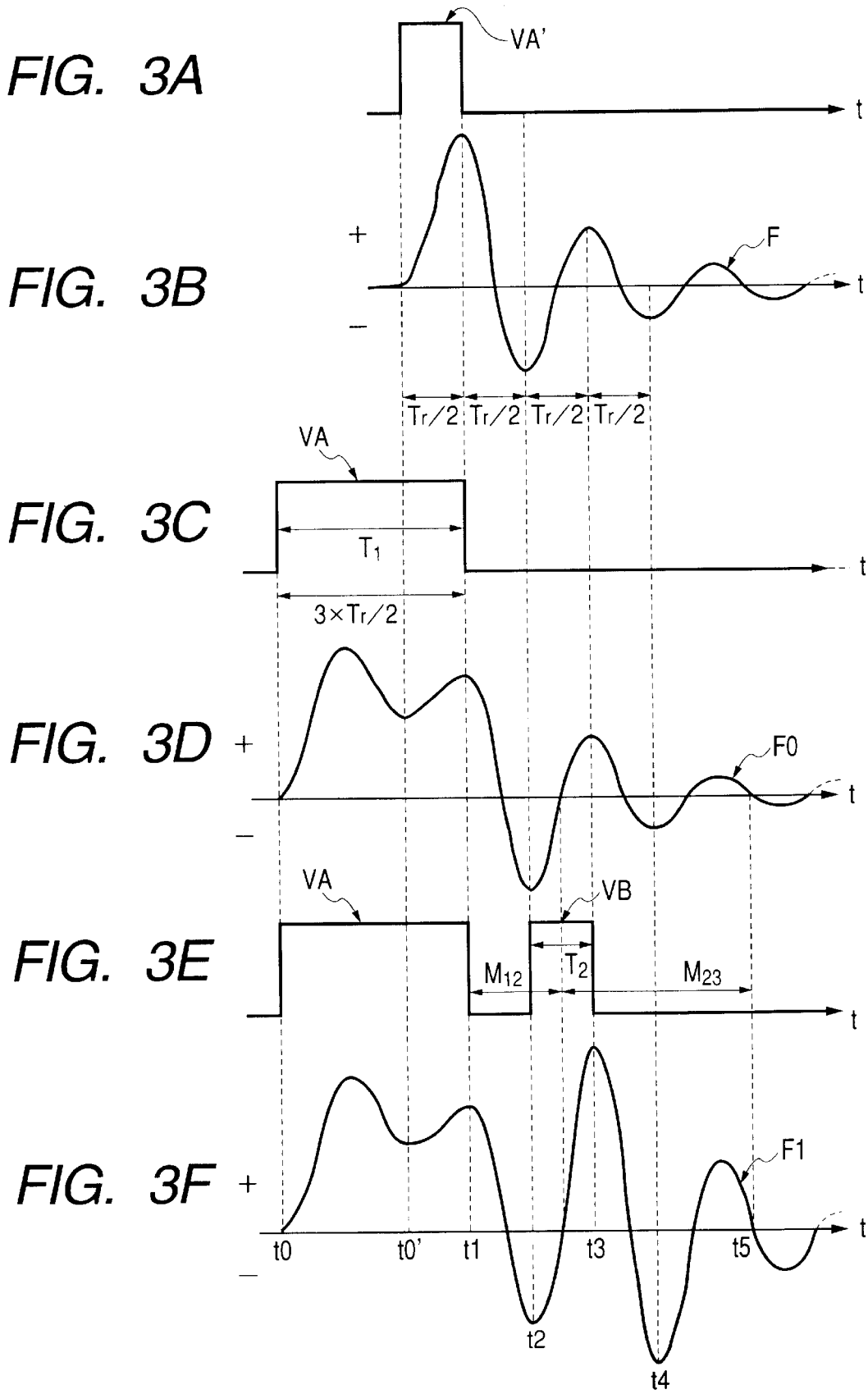
FIGS. 3A, 3B, 3C, 3D, 3E and 3F are views for illustrating preferred forms of the driving method for a liquid discharge head and corresponding displacement of a pressure generating device.
Figure 11:
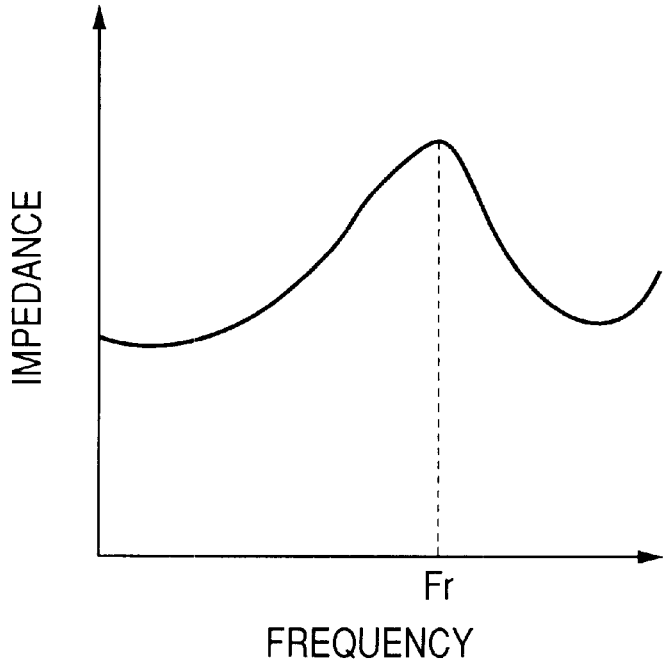
FIG. 11 is a schematic view for illustrating the hydrodynamic resonant frequency.

FIGS. 3A and 3B show vibration of the pressure generating device when only a discharge pulse VA' having a pulse width Tr/2 is applied. The pressure generating device repeatedly vibrates in period Tr with the amplitude decreasing, and is gradually prevented from vibrating. In practice, the period Tr depends upon the pressure generating device, as well as the hydrodynamic resonant frequency Fr of the liquid discharge head which depends upon the shape and size of the discharge port, the shape and size of the pressure-applying portion, the volume and density of the liquid in the head, etc. That is, Tr=1/Fr. In particular, in a liquid discharge head group formed of a plurality of liquid discharge heads, the hydrodynamic resonant frequency Fr may vary from one discharge port to another, i.e., from one head to another. The hydrodynamic resonant frequency Fr may also be determined from the frequency dependency of impedance using a well-known impedance measurement device which is connected to the pressure generating device (see FIG. 11).

When a discharge pulse VA having a pulse width of $T_1=N\times Tr/2$, for N=3, is applied to a liquid discharge head having such a characteristic, the vibration shown in FIGS. 3C and 3D is obtained. If N is set to an odd number more than one, resonance can be used to effectively discharge a liquid drop.

If a second discharge pulse is applied after an application of the first discharge pulse VA shown in FIG. 3C, the second discharge pulse is applied at the timing shown in FIG. 3E. The pulse width Tr/2 which can provide high discharge efficiency is chosen for the pulse width $T_2$ of the second discharge pulse VB. The second discharge pulse VB is applied when the pressure generating device is displaced at the highest speed from the direction in which the liquid is pressurized to the reverse direction. In other words, the second discharge pulse VB is applied when time $M_{12}$ elapses from the time t1. The time $M_{12}$ is a period 3/2 times Tr/2. Therefore, the period (rest time) from the time t1 to the time t2 is found as $K_{12}=3T_1/2N-T_2/2$, or $K_{12}=3Tr/4-T_2/2$.

Then, the maximum amplitude at the time $t_3$ allows the second liquid drop to be discharged at a higher speed than the first liquid drop, while the first and second liquid drops have substantially the same volume.

In the liquid discharge head group to be driven, the hydrodynamic resonant frequency FR may often vary from one head to another due to lack of uniformity in production, etc. In order to overcome this problem, if the pulse widths and the rest time are to be optimized for each head, a complicated driving circuit is required. Taking variation in characteristics of the liquid discharge head group into consideration, the pulse widths and the rest time should be set within a range having an allowance of 0.9 to 1.1 times the optimal values as a requirement for the aforementioned advantages. Selectable ranges of the pulse widths and the rest time are set as follows:

$$T_1=k_1\times N\times Tr/2$$

$$T_2=k_2\times Tr/2$$

$$K_{12}=k_3\times(3Tr/4-T_2/2)$$

where $k_1$, $k_2$, and $k_3$ denote values each ranging from 0.9 to 1.1.

Figure 4G:
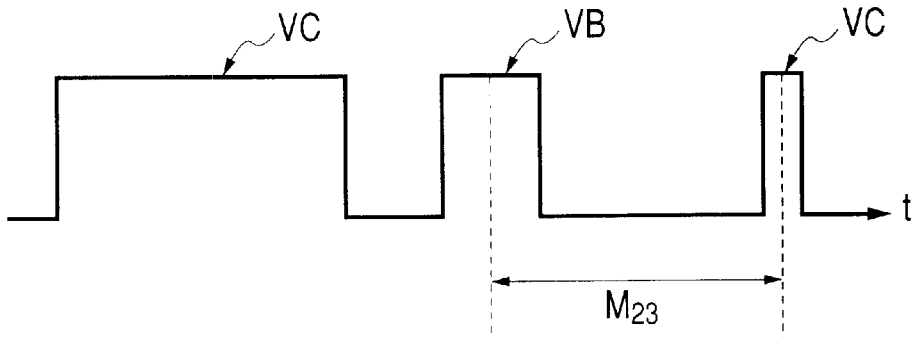
FIGS. 4G and 4H are views for illustrating another form of the driving method for a liquid discharge head and corresponding displacement of a pressure generating device.
Figure 4H:
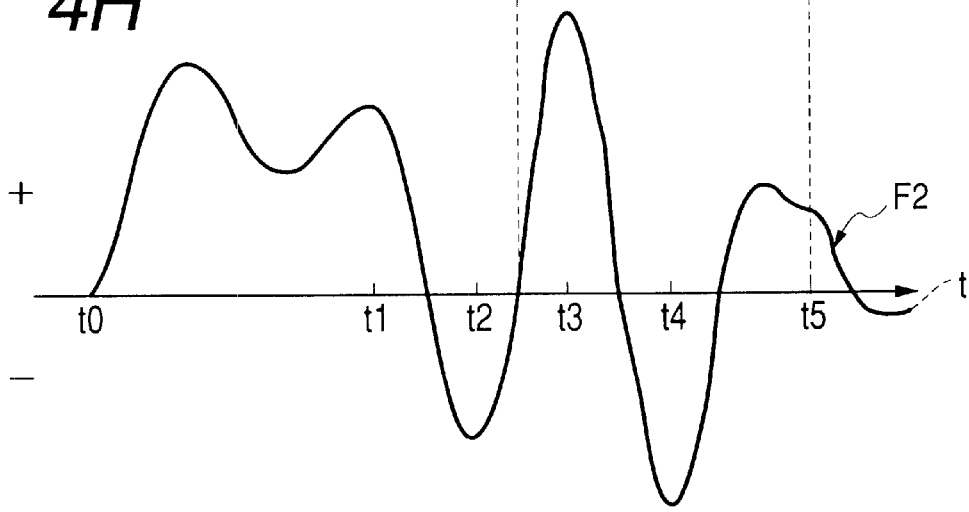

FIGS. 4G and 4H show vibration state of the pressure generating device of the liquid discharge head when a non-discharge pulse is applied to the driving signal shown in FIG. 3E.

At time t5, which is a time when $M_{23}$ has elapsed from the intermediate time of the pulse VB or the intermediate time point between the rising time t2 and the falling time t3 of the pulse VB, a non-discharge pulse VC is applied.

Preferably, $M_{23}=3\times Tr/2$.

As shown in FIGS. 3D and 3F, the time t5 is a time when the pressure generating device causes the pressure-applying portion to change from the expanding state to the contracting state, that is, the time when a force for expelling liquid from the discharge port is applied and when, theoretically, the liquid is expelled at the highest speed. Therefore, if a reverse force is applied to the pressure generating device at about the time t5, vibration of the pressure generating device is suppressed to make much weaker a force for expelling the liquid.

In particular, in FIGS. 3E and 3F, since the vibration after the second liquid drop 23 is discharged is amplified in response to the discharge pulse VB, it is effective to apply the non-discharge pulse as shown in FIGS. 4G and 4H.

If the pulse width of the non-discharge pulse VC applied subsequently to the second discharge pulse VB is indicated by $T_3$, then, $T_3<Tr/2$, and, preferably, $T_3$ (0.5×Tr/2. For a liquid discharge head group having a plurality of discharge ports, in particular, preferably, $T_3=k_4\times Tr/2$, where k4 ranges from 0.2 to 0.5.

If the period from the falling time t3 of the second discharge pulse VB to the rising time of the non-discharge pulse VC, that is, the rest time between the second discharge pulse VB and the non-discharge pulse VC, is indicated by $K_{23}$, preferably, $K_{23}=3T_1/N-T_2/2-T_3/2$.

More preferably, from a value obtained by subtracting, from $M_{23}$, the half the pulse width of the second discharge pulse and the half the pulse width of the non-discharge pulse, i.e., $K_{23}=3Tr/2-T_2/2-T_3/2$, $K_{23}=k_5\times(3Tr/2-T_2/2-T_3/2)$ is derived, where $k_5$ ranges from 0.9 to 1.1.

(Liquid Discharge Head)

A preferable liquid discharge head used in the present invention includes a pressure generating device which is displaced at least in a part in response to an application of an electric signal so that a pressure can be applied to liquid introduced into a pressure-applying portion, and a discharge port communicating with the pressure-applying portion. In particular, a piezoelectric actuator which is displaced in response to an application of a unipolar voltage to decrease the pressure applied to the liquid and which is displaced back in response to a cancellation of that voltage to expel the liquid is suitably used.

An exemplary liquid discharge head is now described with reference to the drawings. As in that shown in FIGS. 9A and 9B, an exemplary liquid discharge head (ink jet head) used in the present invention includes a bottom wall 501, a top wall 502, and shear-mode actuator walls (pressure generating devices) 503 held therebetween. Each of the actuator walls 503 is formed of a lower wall 507 which is bonded to the bottom wall 501 and which is polarized in the direction indicated by an arrow 511, and an upper wall 505 which is bonded to the top wall 502 and which is polarized in the direction indicated by an arrow 509. A pair of adjacent actuator walls 503 forms an ink flow path (pressure-applying portion) 506.

An air chamber 508 formed of a gap containing no ink is provided between adjacent ink flow paths 506.

An orifice plate 512 having a nozzle (discharge port) 510 is bonded to one end of each ink flow path 506, and electrodes 513 and 514 are provided as metallized layers on both sides of each actuator wall 503. More specifically, each actuator wall 503 is provided with the electrode 514 on the side of the ink flow path 506, and is provided with the electrode 513 on the side of the air chamber 508. The electrodes 513 facing the air chamber 508 are connected to a control circuit (driving circuit) 520 for supplying an actuator driving signal, while the electrodes 514 defining the ink flow path 506 are connected to a ground.

Driving Circuit

A driving circuit used in the present invention may be implemented as a circuit for supplying the driving signal shown in FIGS. 1A and 1B or FIGS. 4G and 4H to the head in response to an instruction of one-dot discharge.

Figure 5:
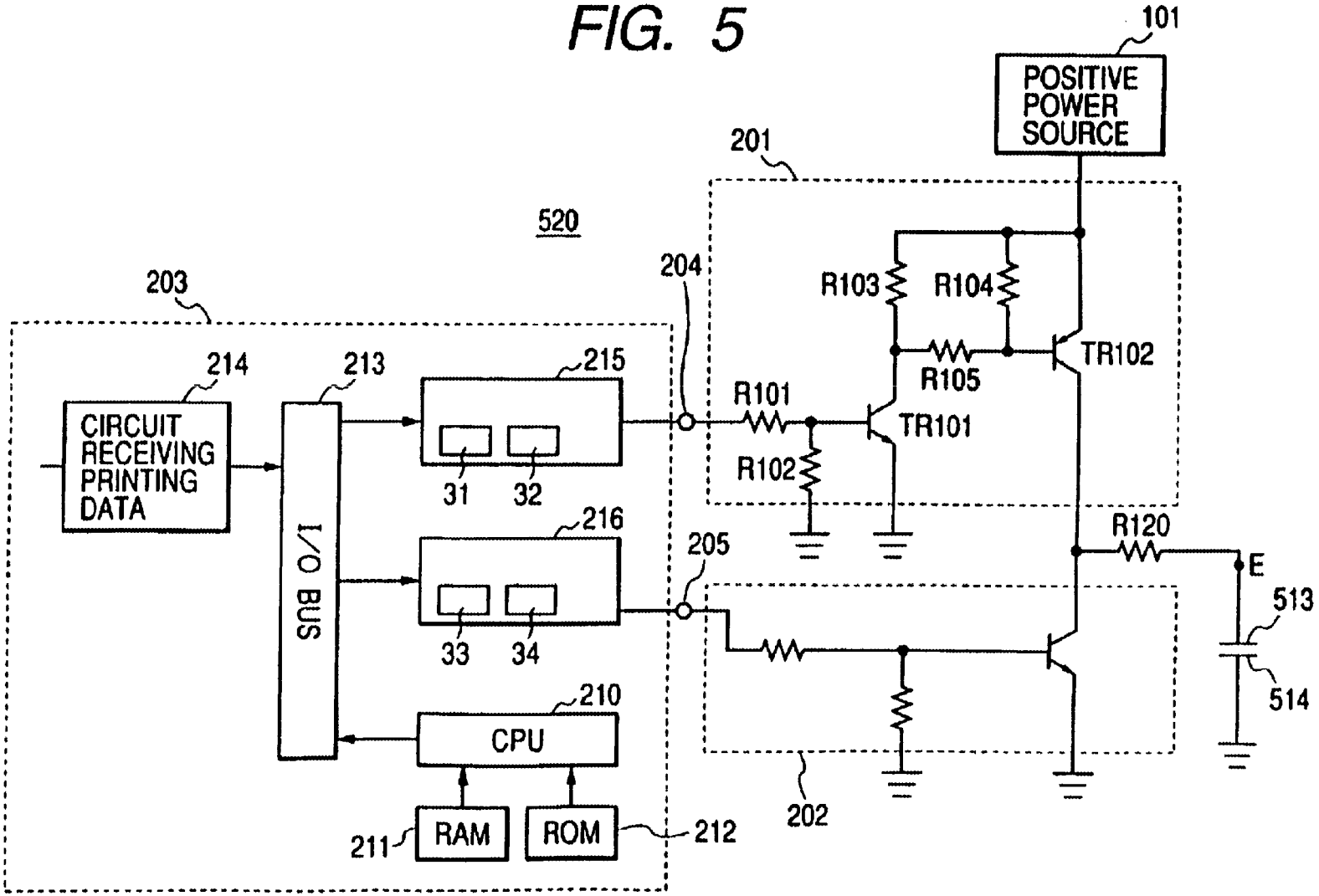
FIG. 5 is a diagram of a driving circuit for a liquid discharge head used in the present invention.
Figure 9A:
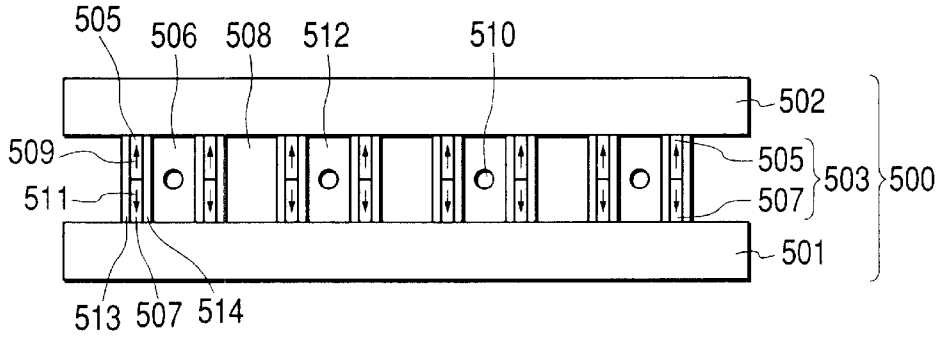
FIGS. 9A and 9B are diagrams of a liquid discharge head.
Figure 9B:
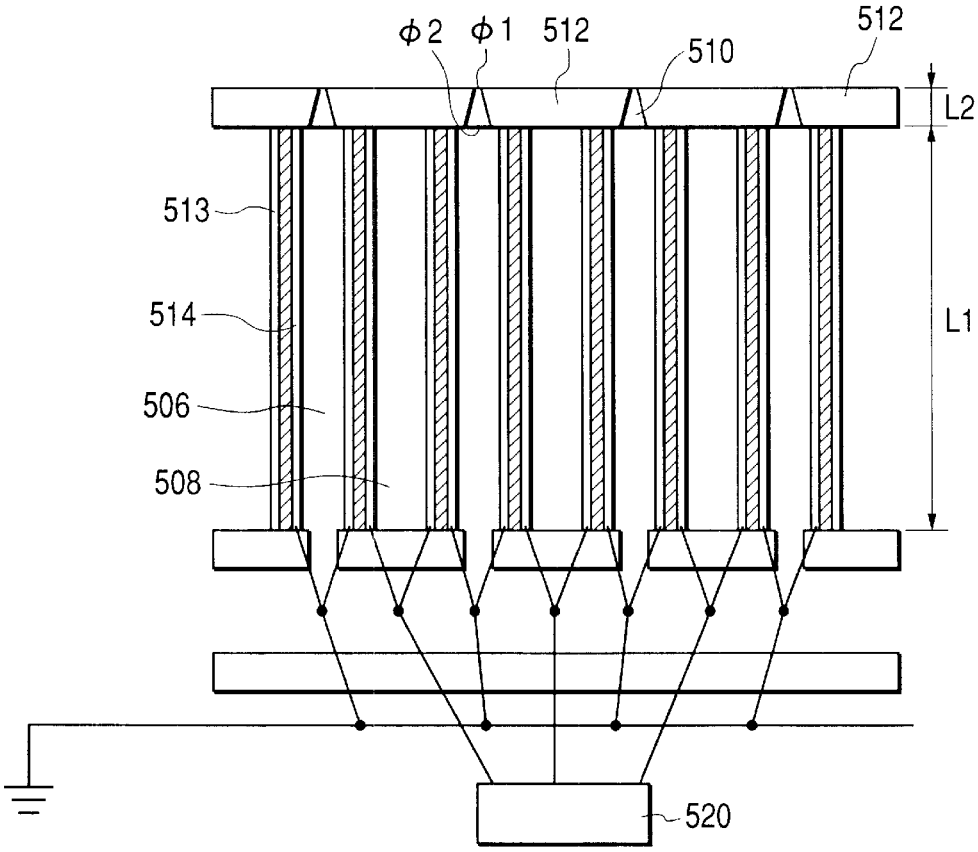
Figure 10:
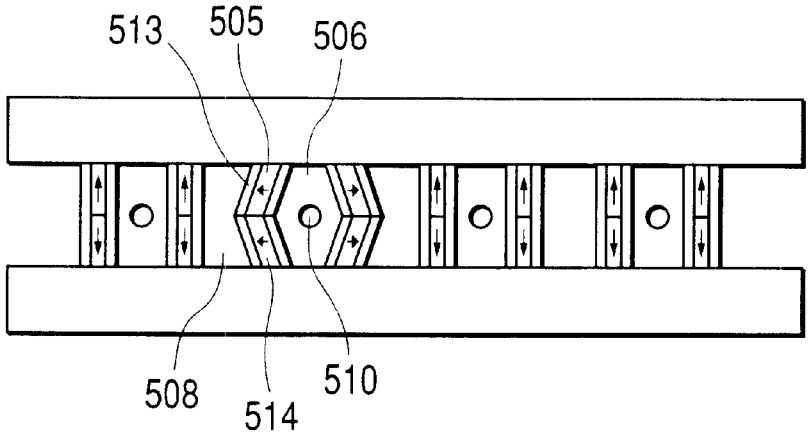
FIG. 10 is a schematic diagram for illustrating the operation of the liquid discharge head.

FIG. 5 shows a specific example of the driving circuit 520 shown in FIG. 9A according to the present invention. The circuit 520 shown in FIG. 5 includes a charging circuit 201, a discharging circuit 202, and a pulse control circuit 203. An input terminal 204 is an input terminal for inputting a pulse signal for setting a voltage applied to the electrodes 513 beside the air chamber 508 to E (V), and an input terminal 205 is an input terminal for inputting a pulse signal for setting a voltage applied to the electrodes 513 to 0 (V). The charging circuit 201 is formed of resistors R101, R102, R103, R104, and R105, and transistors TR101 and TR102.

When an ON signal (+5 V) is input to the input terminal 204, the transistor TR101 is conducting via the resistor R101, thus causing a current from a positive power source 101 to flow from the collector toward the emitter of the transistor TR101 via the resistor R103. Therefore, the divided voltages applied to the resistors R104 and R105 connected to the positive power source 101 increase, allowing a current flowing to the base of the transistor TR102 to increase, so that the emitter and collector of the transistor TR102 are electrically connected with each other. This allows a voltage of +20 V to be applied from the positive power source 101 to the electrode 513 beside the air chamber 508 via the collector and emitter of the transistor TR102 and via the resistor R120. This operation is performed at times Tm1, Tm3, and Tm5 shown in the timing charts in FIGS. 6A, 6B and 6C.

Figure 6A:
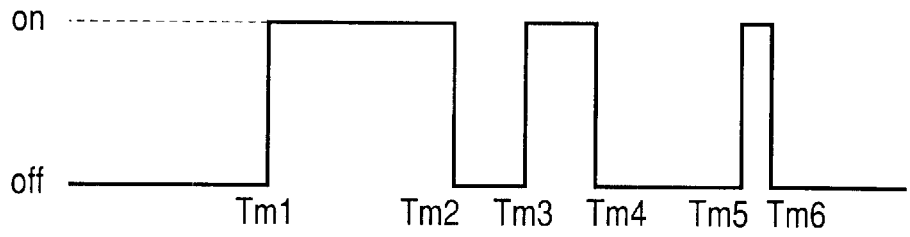
FIGS. 6A, 6B and 6C are timing charts for driving the driving circuit shown in FIG. 5.
Figure 6B:
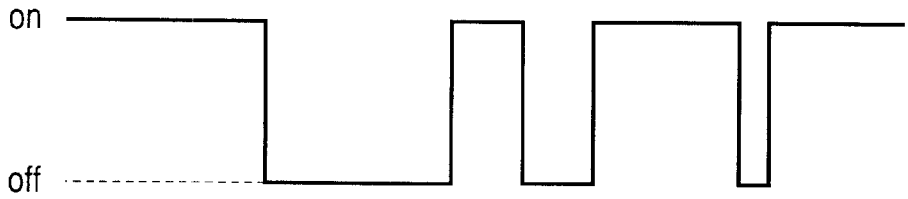
Figure 6C:
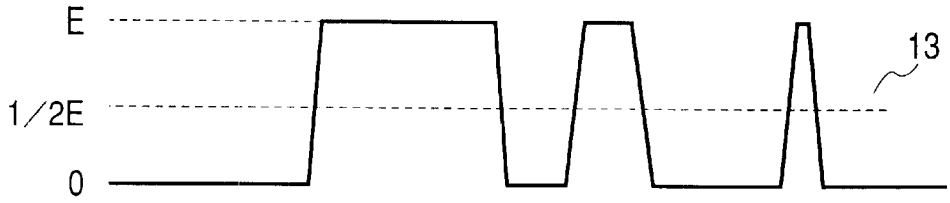

FIGS. 6A, 6B and 6C are timing charts of the input signals applied to the input terminals 204 and 205 of the control circuit 520. The signal input to the input terminal 204 of the charging circuit 201 is normally off, as shown in the timing chart in FIG. 6A. The signal is turned on at a predetermined time Tm1 for ejecting ink, and is turned off at a time Tm2. The signal is again turned on at time Tm3, and is turned off at time Tm4. Then, the signal is again turned on at time a Tm5, and is turned off at a time Tm6. The signal input to the input terminal 205 of the discharging circuit 202 shown in FIG. 5 is turned off, as shown in the timing chart in FIG. 6B, when the input signal to the charging circuit 201 is turned on, while the signal input to the discharging circuit 202 is turned on when the signal input to the charging circuit 201 is turned off. The discharging circuit 202 is a mechanism which allows charge stored in the piezoelectric device to be immediately discharged.

The pulse control circuit 203 which generates a pulse signal which is input to the input terminal 204 of the charging circuit 201 and to the input terminal 205 of the discharging circuit 202 at the times Tm1, Tm2, Tm3, Tm4, Tm5 and Tm6 is now described. FIG. 6C is a timing chart of the actually applied voltage, in which waveform rounding occurs at the rising and falling times of the voltage. The time constant of the circuit is designed so that waveform rounding is reduced to 3 $\mu$s or lower, thereby reducing the influence of waveform rounding (a reduction in discharge efficiency). Preferably, the waveform rounding is controlled to be 3 $\mu$s or lower, and the timing is set so that the pulse width is controlled so as to have a voltage half the driving voltage.

In FIG. 5, the pulse control circuit 203 includes a CPU 210 for performing various computing processes. The CPU 210 is connected to a RAM 211 for recording plot data or various data, and a ROM 212 for recording a control program for the pulse control circuit 203 and sequence data for generating an ON or OFF signal at the times Tm1, Tm2, Tm3, Tm4, Tm5 and Tm6. The CPU 210 is further connected to an I/O bus 213 for exchanging various data. Connected to the I/O bus 213 are a plot data receiving circuit 214, and pulse generators 215 and 216. The output of the pulse generator 215 is connected to the input terminal 204 of the charging circuit 201, and the output of the pulse generator 216 is connected to the input terminal 205 of the discharging circuit 202.

For example, the pulse generator 215 has a register 31 and a counter 32, and the pulse generator 216 has a register 33 and a counter 34. Counter values corresponding to the rising and falling time of the pulses VA, VB, and VC are stored in the registers 31 and 33 from the ROM 212. When the counters 32 and 34 count up to these counter values based on the reference clock, the signal is supplied to the input terminals 204 and 205 at the aforementioned times.

The same number of pulse generators 215 and 216, charging circuits 201, and discharging circuits 202 as the number of nozzles of the ink jet head is provided. Although only one nozzle is described in this embodiment, similar control is performed on other nozzles.

The voltage values of the pulses VA, VB and VC may be separately determined, or may be the same, as described above. If the voltage value of the pulse VB is greater than that of the pulse VA, a higher discharge speed can be obtained. The voltage value of the pulse VC may be smaller than those of the pulses VA and VB.

(Liquid Discharge Apparatus)

A liquid discharge apparatus incorporating a driving apparatus for a liquid discharge head according to the present invention is now described.

Figure 7:
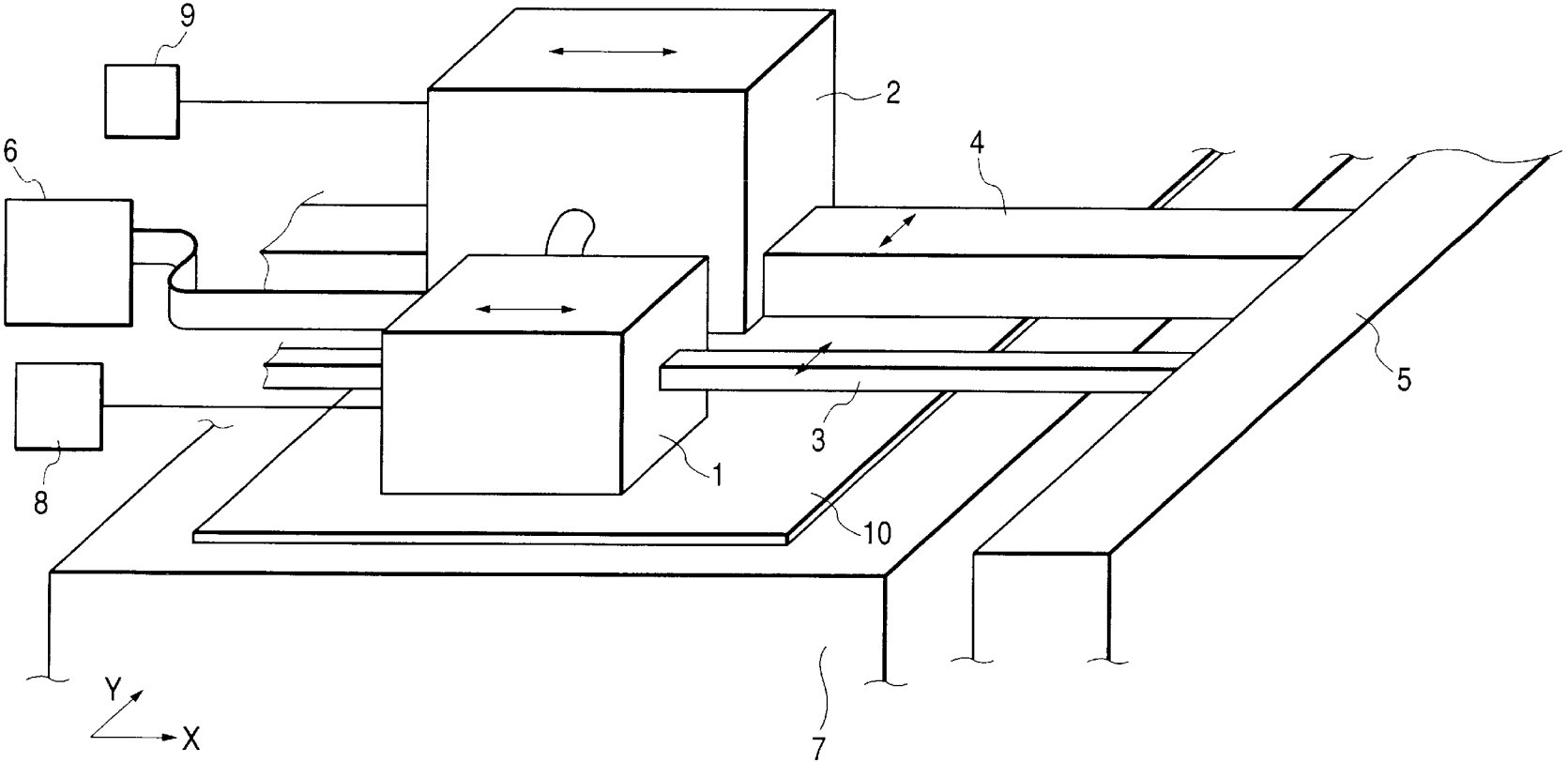
FIG. 7 is a schematic perspective view of a liquid discharge apparatus according to an embodiment of the present invention.

FIG. 7 is a schematic perspective view of the configuration of the liquid discharge apparatus.

Reference numeral 1 denotes a liquid discharge head group including the aforementioned charging circuit and discharging circuit. Reference numeral 2 denotes a container for receiving liquid supplied to the liquid discharge heads. Reference numeral 3 denotes a guide member for guiding the head group 1 in the X direction. Reference numeral 4 denotes a guide member for guiding the container 2 in the X direction.

Reference numeral 5 denotes a linear guide for guiding the guide members 3 and 4 in the Y direction orthogonal to the X direction.

Reference numeral 6 denotes a driving apparatus for the head group 1. The driving apparatus 6 includes the aforementioned pulse control circuit, and is connected to the heads by a flexible cable.

Reference numeral 7 denotes a substrate stage that is a support for supporting a liquid-receiving member 10. Reference numeral 8 denotes a stepping motor serving as a driving unit for driving the head group 1 to reciprocate in the X direction. Reference numeral 9 denotes a stepping motor serving as a driving unit for driving the container 2 to reciprocate in the X direction.

The liquid-receiving member 10 is situated on the substrate stage 7. The head group 1 discharges liquid in the above-described way, while moving in the X direction, to form a dot pattern. When the dot pattern has been formed for one row, the head group 1 one row proceeds in the Y direction to form the dot pattern for the next row. This operation is repeated to plot the dot pattern on the liquid-receiving member 10. While the example where only the head group 1 moves with respect to the fixed substrate stage 7 has been described, the head group 1 and the substrate stage 7 may relatively move, such that the head group 1 may move in the X direction while the substrate stage 7 may move in the Y direction.

The liquid-receiving member 10 may be implemented as a semiconductor wafer, a glass substrate, a plastic substrate, woven fabric, or the like, and may be formed by coating a liquid-receiving layer on any of these materials.

The present invention may be used for manufacturing the source and drain of an organic transistor; a gate electrode; a source electrode; a drain electrode; an electroluminescent layer, anode electrode, or cathode electrode of an organic EL device; a colored layer or light-shielding layer of a color filter; an electrode or electron-emission layer of a light-emitting device; and the like. The present invention may also be applied to production of a DNA chip. Of course, the present invention may be applied to printing onto a sheet of normal paper.

EXAMPLE 1

A head group having the shear-mode actuator shown in FIG. 9 was prepared.

The length L1 of the ink flow path 506 is 8.0 mm. The nozzle 510 on the ink emission side has a diameter $\phi 1$ of 25 $\mu$m, and the nozzle 510 on the ink flow path side has a diameter $\phi 2$ of 40 $\mu$m. The nozzle 510 has a length (the thickness of the orifice plate 512) L2 of 50 $\mu$m.

The ink used in the experiment has a viscosity of 6 mPa·s at 25° C., and a surface tension of 50 mN/m. The hydrodynamic resonant frequency of an association system of ink and a pressure-applying portion in the ink flow path was measured using an impedance measurement device, and an inverse thereof Tr=20 $\mu$sec was determined.

A liquid-receiving member is placed on a substrate stage, and the distance between the surface of the liquid-receiving member and the surface of the orifice plate of the head was set to 300 $\mu$m.

Figure 8:
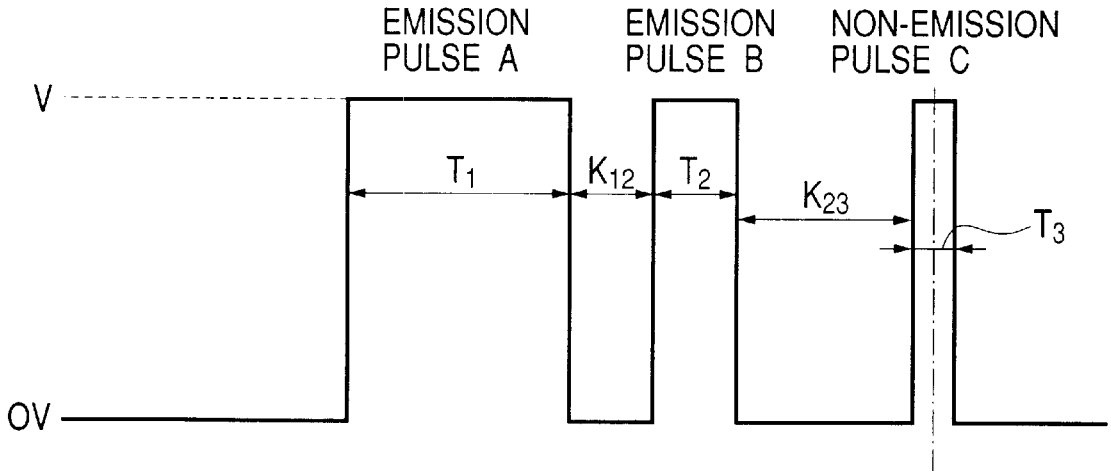
FIG. 8 is a driving waveform of an ink-ejecting apparatus according to an embodiment of the present invention.

The driving waveform shown in FIG. 8 was applied to the electrodes 513 beside the air chambers 508. The driving waveform is the same as shown in FIGS. 4G and 4H, and is formed of emission pulse signals A and B for emitting ink droplets, and a non-emission pulse signal C for allowing vibration of the residue in the ink flow path 506 to be reduced. The emission pulse signals A and B and the non-emission pulse signal C has the same voltage value. The width T1 of the emission pulse signal A was set to $T_1=3\times Tr/2=30$ $\mu$sec.

The width $T_2$ of the second emission pulse signal B was set to $T_2=Tr/2=10$ $\mu$sec.

The time interval $K_{12}$ from the falling time of the emission pulse A to the rising timing of the emission pulse B was set to $K_{12}=Tr/2=10$ $\mu$sec.

The width $T_3$ of the non-emission pulse signal C was set to $T_3=0.4\times Tr/2=4$ $\mu$sec.

The time interval $K_{23}$ from the falling time of the emission pulse signal B to the rising time of the non-emission pulse signal C was set to $K_{23}=3\times Tr/2-T_2/2-T_3/2=23$ $\mu$sec.

In this way, the emission pulse signals A and B, and the non-emission pulse signal C were sequentially applied to the actuators in response to one-dot emission signal to perform plotting while moving the head group so that a plurality of dots are not applied to the same position on the liquid-receiving member.

A larger liquid drop was ejected in response to the emission pulse A while a slightly smaller but faster liquid drop was ejected in response to the emission pulse B, thus allowing a large-volume liquid drop to be applied as one dot. In addition, the non-emission pulse signal C was applied at a normal-position timing in which the piezoelectric device changes from the expanding state to the contracting state due to vibration of the residue in the ink flow path in response to the emission pulse signal, thereby applying a force in the expanding direction to the piezoelectric device. This allows cancellation between the deformation of the piezoelectric device to the expanding state and to the contracting state, thereby reducing the vibration of the residue that may affect the piezoelectric device.

EXAMPLE 2

The head group was driven in a similar manner as that in Example 1 to perform an emission test. The result is now described in conjunction with Table 1. Table 1 indicates the result when the first emission pulse A and the second emission pulse B in the driving waveform shown in FIG. 8 are applied, and the pulse width of the emission pulse A is taken as a parameter. The ink used herein has a viscosity of 6 mPa·s at 25° C., and a surface tension of 50 mN/m, and is relatively high viscosity liquid in view of ink viscosity.

TABLE 1

| $T_1$ ($\mu$s) | Emission quantity | Speed of main drop formed by combining droplets | Accuracy of arriving point |
|---|---|---|---|
| 24 | 20 | 5.8 | x |
| 25 | 23 | 6.6 | Δ |
| 26 | 25 | 6.9 | Δ |
| 27 | 27.5 | 7 | ○ |
| 28 | 29 | 7.5 | ○ |
| 29 | 29.5 | 7.8 | ○ |
| 30 | 30 | 8 | ○ |
| 31 | 29.5 | 7.9 | ○ |
| 32 | 29 | 7.6 | ○ |
| 33 | 28 | 7.1 | ○ |
| 34 | 26 | 6.5 | Δ |
| 35 | 24.5 | 6.3 | Δ |
| 36 | 22 | 6 | x |

Note:
○ denotes EXCELLENT;
Δ denotes GOOD; and
x denotes BAD.

Table 1 indicates the total amount of discharge of two ink droplets ejected in response to the emission pulses A and B with a driving voltage of 24 V. Table 1 further indicates the discharge speed and deposition precision of the main drop in the two ink droplets which are combined in the air. The variation (fluctuation) in the position accuracy of the arriving liquid drop and the circularity of the arriving liquid drop are used as indexes of the deposition evaluation.

A value ranging from 27 $\mu$s to 33 $\mu$s was satisfactory for the emission pulse width dependency for any evaluation. In this embodiment, if Tr=1/Fr, where Fr denotes the hydrodynamic resonant frequency of an association system of ink and a pressurizing unit in the ink flow path, then, Tr=20 $\mu$s is found, proving that a satisfactory pulse width is within $0.9\times 3\times Tr/2 \leqq T_1 \leqq 1.1\times 3\times Tr/2$.

EXAMPLE 3

In a similar manner as that in Example 2, the pulse width of the emission pulse B was used as a variable parameter to perform a similar evaluation.

$T_1=30$ $\mu$s was used as another parameter, and others are the same as those in Example 2.

In Example 3, it was found that the pulse width $T_2$ when a satisfactory result was obtained is within $9\ \mu s \leqq T_2 \leqq 11\ \mu s$.

COMPARATIVE EXAMPLE

As comparison, although not shown in FIGS. 4G and 4H, when a single emission pulse (reference waveform: a pulse width of 10 $\mu$s) was used for driving, the amount of discharge of a liquid drop was 15 pl and the discharge speed was 8.2 m/s.

It is therefore found that the amount of discharge can doubly increase when the emission pulses A and B are applied compared with when the single emission pulse (10 $\mu$s) is used.

EXAMPLE 4

A similar experiment to that of Example 2 was performed using low-viscosity ink, and a similar result to that of Example 2 was obtained.

Only the emission pulses A and B were used for driving. Then, it was found that the discharge state is unstable when the driving frequency increases (for example, 10 kHz or higher) compared with Example 2 (in which high-viscosity ink is used).

The non-emission pulse C was applied in the manner shown in FIG. 8, thereby making the discharge stable even at a high frequency (15 kHz).

The satisfactory pulse width $T_3$ ranged from 2 $\mu$s to 5 $\mu$s, and the rest time $K_{23}$ ranged from 20.7 $\mu$s to 25.3 $\mu$s.

As described in the embodiment of the present invention, therefore, if Tr=1/Fr, where Fr denotes the hydrodynamic resonant frequency of an association system of ink and a pressurizing unit in the ink flow path, the first pulse width T1 of the driving pulse which is first applied for one-dot plotting is not Tr/2 (that is, the piezoelectric device does not contract at the timing when the amplitude of the piezoelectric device to which a pulse is applied becomes first maximum) but 3×Tr/2 (that is, the piezoelectric device contacts at the timing when the amplitude of the piezoelectric device is secondly maximum). This makes it possible to reduce the discharge speed without reducing the amount of discharge when a liquid drop is discharged in response to a first emission pulse. Thus, the first ejected liquid drop and the second ejected liquid drop can be combined before the first and second ejected liquid drops reach the liquid-receiving member. When the liquid drops are combined in the air, the combined liquid drop, which is transformed into an elliptic drop, vibrates for a while until the combined liquid drop becomes sphere and is stabilized. In the embodiment of the present invention, the combined liquid drop stops vibrating, and the resulting sphere drop reaches the base. In order to immediately stop vibration of the combined liquid drop in the air, it is necessary to reduce the difference in momentum between the first liquid drop and the second liquid drop as much as possible. The embodiment of the present invention makes it possible to reduce the difference in momentum between the first liquid drop and the second liquid drop, thereby immediately stopping vibration of the combined liquid drop.

Although one embodiment of the present invention has been described in detail, the present invention is not limited to this embodiment. While a positive power source is used in the embodiment, a negative power source may be used by reversing the polarization direction of the piezoelectric device. The polarization direction of the piezoelectric device may be reversed, and ink chambers may be connected to the positive power source while air chambers are connected to a ground. A pressurizing unit for pressurizing ink may be placed as a portion of an ink flow path. In other words, the present invention is not limited to any mechanism such as ink pressurizing mechanisms or power source mechanisms.

According to the present invention, therefore, two discharge pulses are applied at a predetermined timing in response to an instruction of one-dot discharge, thereby obtaining required amount of discharge. Furthermore, an extremely satisfactory deposition condition can be achieved, and, in particular, liquid can be ejected in a manner suitable for industrial plotting.

What is claimed is:

1.A driving method for a liquid discharge head including a discharge port for discharging liquid, a pressure-applying portion communicating with the discharge port, for applying a pressure for discharge to the liquid, and a pressure-generating device for generating the pressure, said method comprising applying a first discharge pulse for discharging liquid and a second discharge pulse for discharging liquid, to the pressure-generating device in a sequential manner in response to an instruction of one-dot discharge, wherein the following three equations are satisfied:

$$T_1 = k_1 \times N \times Tr/2$$

$$T_2 = k_2 \times Tr/2$$

$$K_{12} = k_3 \times (3Tr/4 - T_2/2),$$

for $k_1$, $k_2$, and $k_3$ each ranging from 0.9 to 1.1, where N denotes an odd number more than one, Tr denotes an inverse of the hydrodynamic resonant frequency of the liquid discharge head, $T_1$ denotes the pulse width of the first discharge pulse, $T_2$ denotes the pulse width of the second discharge pulse, and $K_{12}$ denotes the rest time between the first discharge pulse and the second discharge pulse.

2. A driving method for a liquid discharge head according to claim 1, wherein a driving circuit applies a non-discharge pulse, in response to which liquid is not discharged, subsequent to the second discharge pulse, and the following equations are satisfied:

$$T_3 = k_4 \times Tr/2$$

$$K_{23} = k_5 \times (3Tr/2 - T_2/2$$

for $k_4$ ranging from 0.2 to 0.5 and $k_5$ ranging from 0.9 to 1.1, where $T_3$ denotes the pulse width of the non-discharge pulse, and $K_{23}$ denotes the rest time between the second discharge pulse and the non-discharge pulse.

3. A driving method for a liquid discharge head according to claim 2, further comprising a step of supplying a driving signal including the first discharge pulse and the second discharge pulse to liquid discharge heads, the liquid discharge heads forming a liquid discharge head group having a plurality of the discharge ports, a plurality of the pressure-applying portions, and a plurality of the pressure-generating devices, wherein the pulse width of the first discharge pulse, the pulse width of the second discharge pulse, and the rest time have the same value.

4. A driving method for a liquid discharge head including a discharge port for discharging liquid, a pressure-applying portion communicating with the discharge port, for applying a pressure for discharge to the liquid, and a pressure-generating device for generating the pressure, said method comprising a driving step for applying a first discharge pulse for discharging liquid and a second discharge pulse for discharging liquid, to the pressure-generating device in a sequential manner in response to an instruction of one-dot discharge, wherein the following three equations are satisfied:

$$T_1>Tr$$

$$T_2=T_1/2$$

$$K_{12}=3T_1/2N-T_2/2,$$

where N denotes an odd number more than one, Tr denotes an inverse of the hydrodynamic resonant frequency of the liquid discharge head, $T_1$ denotes the pulse width of the first discharge pulse, $T_2$ denotes the pulse width of the second discharge pulse, and $K_{12}$ denotes the rest time between the first discharge pulse and the second discharge pulse.

5. A driving method for a liquid discharge head according to claim 4, further comprising a step of supplying a driving signal including the first discharge pulse and the second discharge pulse to liquid discharge heads, the liquid discharge heads forming a liquid discharge head group having a plurality of the discharge ports, a plurality of the pressure-applying portions, and a plurality of the pressure-generating devices, wherein the pulse width of the first discharge pulse, the pulse width of the second discharge pulse, and the rest time have the same value.

6. A driving method for a liquid discharge head according to claim 4, wherein in the driving step, a non-discharge pulse is applied, in response to which liquid is not discharged, subsequent to application of the second discharge pulse, and the following equations are satisfied:

$$T_3<Tr/2$$

$$K_{23}=3T_1/N-T_2/2-T_3/2,$$

where $T_3$ denotes the pulse width of the non-discharge pulse, and $K_{23}$ denotes the rest time between the second discharge pulse and the non-discharge pulse.

7. A driving apparatus for a liquid discharge head including a discharge port for discharging liquid, a pressure-applying portion communicating with the discharge port, for applying a pressure for discharge to the liquid, and a pressure-generating device for generating the pressure, the apparatus comprising a driving circuit for applying a first discharge pulse for discharging liquid and a second discharge pulse for discharging liquid, to the pressure-generating device in a sequential manner in response to an instruction of one-dot discharge, wherein the following three equations are satisfied:

$$T_1=k_1\times N\times Tr/2$$

$$T_2=k_2\times Tr/2$$

$$K_{12}=k_3\times(3Tr/4-T_2/2),$$

for $k_1$, $k_2$, and $k_3$ each ranging from 0.9 to 1.1, where N denotes an odd number more than one, Tr denotes an inverse of the hydrodynamic resonant frequency of the liquid discharge head, $T_1$ denotes the pulse width of the first discharge pulse, $T_2$ denotes the pulse width of the second discharge pulse, and $K_{12}$ denotes the rest time between the first discharge pulse and the second discharge pulse.

8. A driving apparatus for a liquid discharge head including a discharge port for discharging liquid, a pressure-applying portion communicating with the discharge port, for applying a pressure for discharge to the liquid, and a pressure-generating device for generating the pressure, the apparatus comprising a driving circuit for applying a first discharge pulse for discharging liquid and a second discharge pulse for discharging liquid, to the pressure-generating device in a sequential manner in response to an instruction of one-dot discharge, wherein the following three equations are satisfied:

$$T_1>Tr$$

$$T_2=T_1/2$$

$$K_{12}=3T_1/2N-T_2/2,$$

where N denotes an odd number more than one, Tr denotes an inverse of the hydrodynamic resonant frequency of the liquid discharge head, $T_1$ denotes the pulse width of the first discharge pulse, $T_2$ denotes the pulse width of the second discharge pulse, and $K_{12}$ denotes the rest time between the first discharge pulse and the second discharge pulse.

9. A liquid discharging apparatus comprising:

a liquid discharge head including a discharge port for discharging liquid, a pressure-applying portion communicating with the discharge port for applying a pressure to the liquid, and a pressure-generating device for generating the pressure;

a driving circuit for applying a first discharge pulse for discharging liquid and a second discharge pulse for discharging liquid, to the pressure generating device in a sequential manner in response to an instruction of one-dot plotting; and a support for supporting a liquid-receiving member for receiving the liquid, wherein a pulse width of the first discharge pulse, a pulse width of the second discharge pulse, and a rest time between the first discharge pulse and the second discharge pulse are determined so that a volume of a first liquid discharged in response to the first discharge pulse is approximately equal to or greater than that of a second liquid discharged in response to the second discharge pulse and a discharge speed of the first liquid is lower than a discharge speed of the second liquid, wherein a position of the liquid discharging head and a position of the support are determined so that the first liquid and the second liquid are combined to be applied to the liquid receiving member, and wherein the following three equations are satisfied:

$$T_1=k_1\times N\times Tr/2$$

$$T_2=k_2\times Tr/2$$

$$K_{12}=k_3\times(3Tr/4-T_2/2),$$

for $k_1$, $k_2$, and $k_3$ each ranging from 0.9 to 1.1, where N denotes an odd number more than one, Tr denotes an inverse of the hydrodynamic resonant frequency of the liquid discharge head, $T_1$ denotes the pulse width of the first discharge pulse, $T_2$ denotes the pulse width of the second discharge pulse, and $K_{12}$ denotes the rest time between the first discharge pulse and the second discharge pulse.

10. A liquid discharging apparatus comprising:

a liquid discharge head including a discharge port for discharging liquid, a pressure-applying portion communicating with the discharge port for applying a pressure to the liquid, and a pressure-generating device for generating the pressure;

a driving circuit for applying a first discharge pulse for discharging liquid and a second discharge pulse for discharging liquid, to the pressure generating device in a sequential manner in response to an instruction of one-dot plotting; and a support for supporting a liquid-receiving member for receiving the liquid, wherein a pulse width of the first discharge pulse, a pulse width of the second discharge pulse, and a rest time between the first discharge pulse and the second discharge pulse are determined so that a volume of a first liquid discharged in response to the first discharge pulse is approximately equal to or greater than that of a second liquid discharged in response to the second discharge pulse and a discharge speed of the first liquid is lower than a discharge speed of the second liquid, wherein a position of the liquid discharging head and a position of the support are determined so that the first liquid and the second liquid are combined to be applied to the liquid receiving member, and wherein the following three equations are satisfied:

$$T_1 > Tr$$

$$T_2 = T_1/2$$

$$K_{12} = 3T_1/2N - T_2/2,$$

where N denotes an odd number more than one, Tr denotes an inverse of the hydrodynamic resonant frequency of the liquid discharge head, $T_1$ denotes the pulse width of the first discharge pulse, $T_2$ denotes the pulse width of the second discharge pulse, and $K_{12}$ denotes the rest time between the first discharge pulse and the second discharge pulse.

* * * * *

UNITED STATES PATENT AND TRADEMARK OFFICE

CERTIFICATE OF CORRECTION

PATENT NO. : 6,676,238 B2
DATED : January 13, 2004
INVENTOR(S) : Hidehiko Fujimura It is certified that error appears in the above-identified patent and that said Letters Patent is hereby corrected as shown below:

Column 3,
Line 17, "causing" should read -- and so --.

Column 6,
Line 25, "$T_2T_1/2$" should read -- $T_2 = T_1/2$ --.

Column 8,
Line 16, "reach" should read -- reaches --.

Column 16,
Line 53, "claim 2," should read -- claim 1, --.

Signed and Sealed this

Thirteenth Day of July, 2004

JON W. DUDAS
*Acting Director of the United States Patent and Trademark Office*